US010801453B2

(12) United States Patent
Zankl et al.

(10) Patent No.: US 10,801,453 B2
(45) Date of Patent: Oct. 13, 2020

(54) HIGH-PRESSURE FUEL PUMP

(71) Applicant: Continental Automotive GmbH, Hannover (DE)

(72) Inventors: Markus Zankl, Waldmünchen (DE); Jurgen Bohmann, Furth i. Wald (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 16/248,165

(22) Filed: Jan. 15, 2019

(65) Prior Publication Data

US 2019/0219016 A1 Jul. 18, 2019

(51) Int. Cl.

| | |
|---|---|
| ***F02M 59/46*** | (2006.01) |
| ***F02M 55/02*** | (2006.01) |
| ***F02M 59/36*** | (2006.01) |
| ***F02M 61/16*** | (2006.01) |
| ***F02M 63/02*** | (2006.01) |

(52) U.S. Cl.

CPC ..... *F02M 55/02* (2013.01); *F02M 59/367* (2013.01); *F02M 61/168* (2013.01); *F02M 63/02* (2013.01); *F02M 61/166* (2013.01); *F02M 2547/001* (2013.01)

(58) Field of Classification Search

CPC ..... F02M 55/02; F02M 59/367; F02M 59/44; F02M 59/445; F02M 59/46; F02M 59/462; F02M 63/02; F02M 61/168; F02M 61/166; F02M 2547/001; F04B 53/16; F04B 53/10

USPC ..... 123/495

See application file for complete search history.

(56) References Cited

U.S. PATENT DOCUMENTS

| | | | | |
|---|---|---|---|---|
| 4,577,606 | A | 3/1986 | Böhringer et al. | 123/506 |
| 8,132,558 | B2 | 3/2012 | Lucas et al. | 123/510 |
| 9,605,634 | B2 | 3/2017 | Yoshimaru et al. | |
| 10,006,423 | B2 * | 6/2018 | Abbas | F02M 59/025 |
| 2014/0314605 | A1 | 10/2014 | Koga et al. | 417/568 |

(Continued)

FOREIGN PATENT DOCUMENTS

| | | | | |
|---|---|---|---|---|
| DE | 10 2008 008 435 | A1 | 8/2009 | F02M 59/46 |
| GB | 2 385 385 | A | 8/2003 | F02M 59/26 |
| JP | S54-30124 | U | 2/1979 | F02M 55/02 |

(Continued)

OTHER PUBLICATIONS

German Office Action, Application No. 10 2018 200 612.1, 4 pages, dated Nov. 16, 2018.

(Continued)

*Primary Examiner* — Hai H Huynh

(74) *Attorney, Agent, or Firm* — Slayden Grubert Beard PLLC

(57) ABSTRACT

Various embodiments include a high-pressure port for a fuel pump comprising: a body defining an internal volume; an outlet valve with an element opening in a first direction; a pressure-limiting valve with an element opening in an opposite second direction; a common valve plate including a sealing seat for both valve elements; and a sleeve guiding the outlet valve element during movement, fastened in the body with an axial stop limiting movement of the outlet valve element and a radial guide guiding the outlet valve element during movement. The guiding sleeve comprises a harder material than the body.

9 Claims, 2 Drawing Sheets

(56) References Cited

U.S. PATENT DOCUMENTS

| | | | | |
|---|---|---|---|---|
| 2015/0078922 | A1 | 3/2015 | Oikawa et al. | 417/213 |
| 2015/0361935 | A1 | 12/2015 | Nakaoka | 417/437 |

FOREIGN PATENT DOCUMENTS

| | | | | |
|---|---|---|---|---|
| JP | H02-132847 | U | 11/1990 | F02M 59/46 |
| JP | 2012136994 | A | 7/2012 | F02M 51/00 |
| JP | 2014080964 | A | 5/2014 | F02M 51/06 |
| JP | 2014224523 | A | 12/2014 | F02M 59/02 |
| JP | 2015075049 | A | 4/2015 | F02M 59/46 |
| JP | 2017066956 | A | 4/2017 | F02M 59/44 |
| JP | 2017141725 | A | 8/2017 | F02M 59/44 |
| KR | 20150027127 | A | 3/2015 | F02M 45/02 |

OTHER PUBLICATIONS

Korean Office Action, Application No. 2019092180882, 12 pages, dated Dec. 19, 2019.

* cited by examiner

HIGH-PRESSURE FUEL PUMP

CROSS-REFERENCE TO RELATED APPLICATIONS

This application claims priority to DE Application No. 10 2018 200 612.1 filed Jan. 16, 2018, the contents of which are hereby incorporated by reference in their entirety.

TECHNICAL FIELD

The present disclosure relates to pumps. Various embodiments may include a high-pressure port for a high-pressure fuel pump for a fuel injection system and/or a high-pressure fuel pump which has such a high-pressure port.

BACKGROUND

High-pressure fuel pumps in fuel injection systems are used to subject a fuel to a high pressure, e.g., in a range from 150 bar to 500 bar in gasoline internal combustion engines and in a range from 1500 bar to 3000 bar in diesel internal combustion engines. The greater the pressure which can be generated in the particular fuel, the lower the emissions which arise during the combustion of the fuel in a combustion chamber, this being advantageous in particular against the background of a reduction in emissions being desired to an ever greater extent.

The fuel subjected to high pressure in the high-pressure fuel pump is normally conducted via a high-pressure port, which is fastened to a pump housing of the high-pressure fuel pump, to a high-pressure region of the fuel injection system in which, for example, a so-called common rail is arranged, from where a supply is provided for injectors for the injection of the fuel into combustion chambers of the internal combustion engine. In order to be able to ensure correct functioning of the fuel injection system, a fuel injection system generally has at least two valves, specifically firstly an outlet valve and secondly a pressure-limiting valve. The outlet valve functions as a high-pressure valve, which controls the pressure increase in a pressure chamber of the high-pressure fuel pump. If the high-pressure fuel pump is designed as a piston pump, the outlet valve opens during an upward movement of a pump piston, and the fuel can be delivered into the high-pressure region. During the downward movement of the pump piston, the outlet valve closes, with the result that a return flow of the compressed fuel from the high-pressure region into the pressure chamber is prevented.

The pressure-limiting valve has the function of preventing an excessive pressure increase in the high-pressure region. If the pressure in the high-pressure region exceeds a particular value, then a certain volume flow of the fuel is discharged via the pressure-limiting valve either into the pressure chamber or into a low-pressure region arranged upstream of the high-pressure fuel pump. For reasons of space, it is known for example to arrange both valves, the outlet valve and the pressure-limiting valve, in a high-pressure port for the high-pressure fuel pump. Examples of this are shown in US 2015/0078922 A1 and JP H 02 132847 U.

SUMMARY

Such high-pressure ports, which integrate the two valves, have the disadvantage that they have a relatively short lifetime and become worn very quickly during operation. The teachings of the present disclosure describe an improved high-pressure port having an integrated outlet valve and pressure-limiting valve. For example, some embodiments include a high-pressure port (10) for a high-pressure fuel pump (14) of a fuel injection system having: an outlet valve (26) with an outlet valve element (36) which opens in a first direction; a pressure-limiting valve (28) with a pressure-limiting valve element (56) which opens in a second direction, which is opposite the first direction; a common valve plate (30), which provides a first sealing seat (32) for the outlet valve element (36) and a second sealing seat (34) for the pressure-limiting valve element (56); and a guiding sleeve (42) for guiding the outlet valve element (36) during the opening movement of the latter, wherein the guiding sleeve (42) is fastened in the high-pressure port (10) so as to be pressed in and has an axial stop (48) for limiting the opening movement of the outlet valve element (36) and also a radial guide (46) for guiding the outlet valve element (36) during the opening movement of the latter, wherein the guiding sleeve (42) is formed from a harder material than the high-pressure port (10).

In some embodiments, the outlet valve (26) has a return spring (52) for returning the outlet valve element (36) into a closed position, wherein the guiding sleeve (42) has a spring receiving region (54) for retaining and guiding the return spring (52).

In some embodiments, the outlet valve element (36) is formed as a plate-shaped valve element and has a planar sealing surface (38), wherein the valve plate (30) has at least two planar, annular sealing surfaces (74), which interact with the planar sealing surface (38) of the outlet valve element (36) for the purpose of closing the outlet valve (26), wherein an encircling annular duct (72) is formed between the two annular sealing surfaces (74).

In some embodiments, the valve plate (30) has through-flow openings (68) which are arranged in the valve plate (30) so as to be distributed in a uniformly annular manner and open out into the encircling annular duct (72).

In some embodiments, the valve plate (30) is fastened in the high-pressure port (10) so as to be pressed in and calked, wherein the valve plate (30) has an annular relief groove (76) in a region of the second sealing seat (34) in order to dissipate pressing and calking forces.

In some embodiments, a spring carrier (62) for a return spring (58) for returning the pressure-limiting valve element (56) into a closed position is pressed into the high-pressure port (10) and is formed from a harder material than the high-pressure port (10) and projects beyond an end region (18) of the high-pressure port (10) in the axial direction.

In some embodiments, the outlet valve element (36), the pressure-limiting valve element (56), a first passage opening (64) in the valve plate (30) and a second passage opening (66) in the outlet valve element (36) are arranged coaxially.

As another example, some embodiments include a high-pressure fuel pump (10) for subjecting a fuel in a fuel injection system of an internal combustion engine to high pressure, having a pump housing (12) in which the fuel is subjected to high pressure, and having a high-pressure port (10) according to the description above which is arranged in a housing recess (16) and is fixedly welded to the pump housing (12), wherein the spring carrier (62) which projects beyond the end region (18) of the high-pressure port (10) in the axial direction is arranged in the housing recess (16) with a clearance fit, in particular with a clearance of 0.03-0.07 mm.

In some embodiments, the pump housing (12) forms, in the housing recess (16), an angled shoulder (22) with an angle $\gamma \leq 90°$, wherein the end region (18) of the high-pressure port (10) has a turned groove (20), wherein the shoulder (22) and the turned groove (20) interact so as to form a free space (24).

BRIEF DESCRIPTION OF THE DRAWINGS

Further teachings of the present disclosure are explained in more detail below on the basis of the appended drawings, in which:

FIG. 2 shows a perspective illustration of the valve plate from FIG. 1, viewed from the direction of the outlet valve.

DETAILED DESCRIPTION

Figure 1:
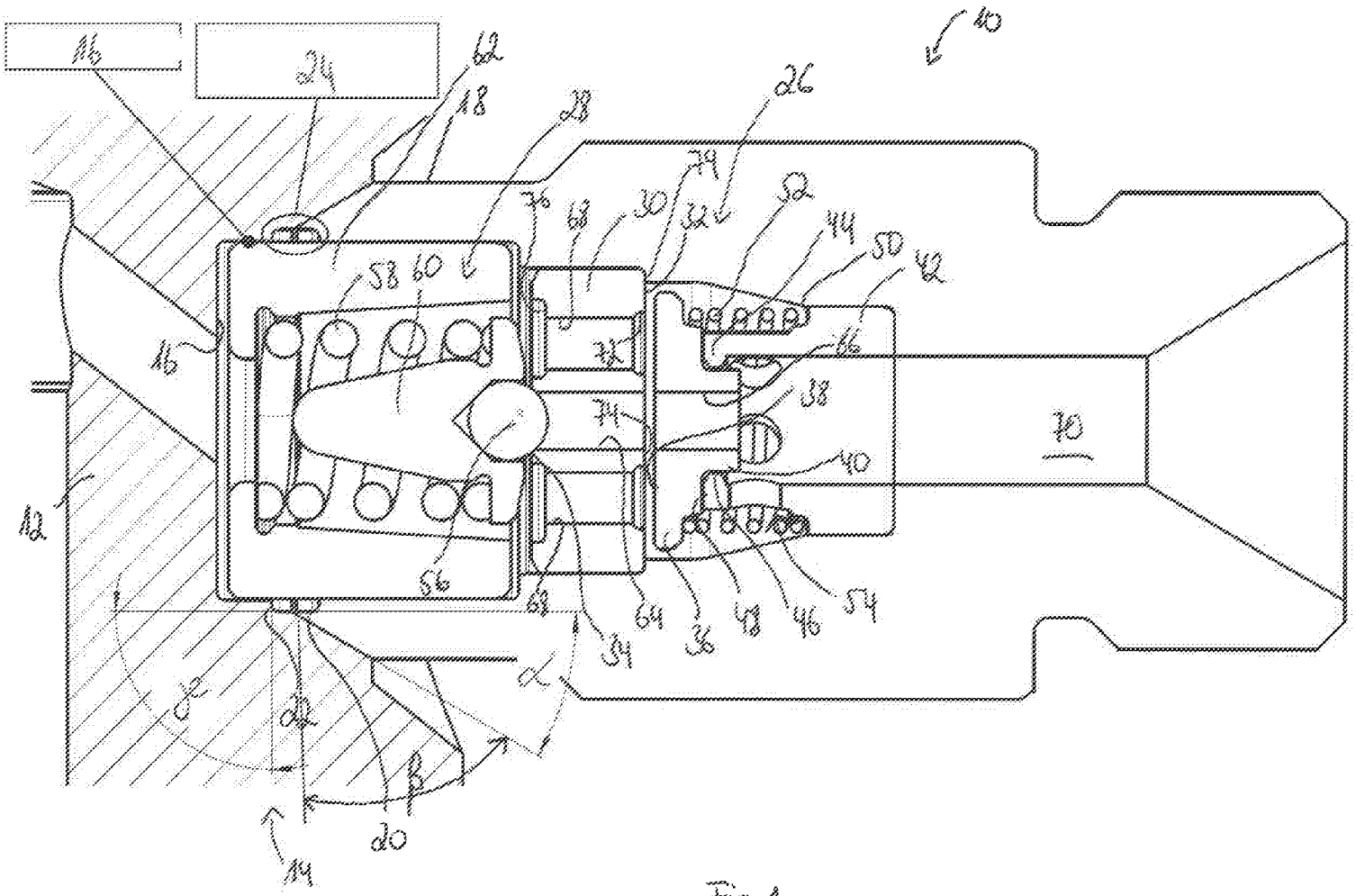
FIG. 1 shows a sectional illustration of a high-pressure port on a pump housing of a high-pressure fuel pump incorporating teachings of the present disclosure, having an outlet valve and a pressure-limiting valve, which are arranged on a common valve plate.

In some embodiments, a high-pressure port for a high-pressure fuel pump of a fuel injection system has an outlet valve with an outlet valve element which opens in a first direction, and has a pressure-limiting valve with a pressure-limiting valve element which opens in a second direction, which is opposite the first direction. Additionally, the high-pressure port has a common valve plate, which provides a first sealing seat for the outlet valve element and a second sealing seat for the pressure-limiting valve element. The high-pressure port furthermore has a guiding sleeve for guiding the outlet valve element during the opening movement of the latter, wherein the guiding sleeve is fastened in the high-pressure port so as to be pressed in and has an axial stop for limiting the opening movement of the outlet valve element and also a radial guide for guiding the outlet valve element during the opening movement of the latter, wherein the guiding sleeve is formed from a harder material than the high-pressure port.

It has been found in practice that, for forming a high-pressure port, use is normally made of soft, easily weldable materials in order to be able to realize an expedient joining process through welding of the high-pressure port to a pump housing of a high-pressure fuel pump. If, however, the outlet valve and the pressure-limiting valve are arranged in the high-pressure port, the result is a plurality of interfaces of moving components between in particular the outlet valve and the high-pressure port, which are loaded in a highly dynamic manner, whereby the high-pressure port already suffers from fatigue or becomes worn after a short running time. This can give rise to introduction of particles into the entire fuel injection system, and it is likewise possible that a changed valve stroke and varying switching times lead to premature system failure.

As a consequence, some embodiments include a high-pressure port formed from a soft material in order to provide the ease of welding to a pump housing, but within the high-pressure port a special guiding sleeve formed from a harder material than the high-pressure port and thus becomes worn less quickly. Said guiding sleeve radially guides the constantly moving outlet valve element in its opening and closing movements and at the same time provides an axial stop for the outlet valve element. The interface susceptible to wear is thus no longer situated between the high-pressure port itself and the outlet valve element, as previously known, but between the outlet valve element and the guiding sleeve, which is for this purpose additionally formed from a harder material than the high-pressure port. The guiding sleeve thus forms a central component and is designed from heat-treated material and introduced in the soft high-pressure port via a press-fit assembly. The guiding sleeve thus performs radial guidance of the outlet valve element and provides an axial stop for limiting the valve stop. In this way, the interfaces are formed in a highly resistant and robust manner.

In some embodiments, a return spring which presses the outlet valve element onto the first sealing seat may be dispensed with since the prevailing pressure in the high-pressure region of the fuel injection system is already sufficient for closing the outlet valve. In some embodiments, the outlet valve has a return spring for returning the outlet valve element into a closed position, wherein the guiding sleeve has a spring receiving region for retaining and guiding the return spring. Consequently, a further interface prone to wear, namely between the return spring and the spring receptacle or spring guide, is also formed in a highly resistant and robust manner.

In some embodiments, the outlet valve element is formed as a plate-shaped valve element and has a planar sealing surface, wherein the valve plate has at least two planar, annular sealing surfaces, which interact with the planar sealing surface of the outlet valve element for the purpose of closing the outlet valve, wherein an encircling annular duct is formed between the two annular sealing surfaces. In some embodiments, the valve plate has throughflow openings which are arranged in the valve plate so as to be distributed in a uniformly annular manner and open out into the encircling annular duct. Consequently, by contrast with known arrangements from the prior art, the outlet valve element is no longer flowed around by means of flow transfer ducts but via an encircling annular duct, which yields advantages in terms of flow.

In some embodiments, sealing by the outlet valve is realized via highly planar sealing surfaces, which are on the outlet valve element and on the valve plate. The valve plate is provided with the throughflow openings, which open out into the annular duct toward the outlet valve element. The annular duct has the function of increasing the surface pressure of the outlet valve element on the valve plate and thus the sealing function. Furthermore, there is a reduction in the flow speed of the flowing fluid at the mouth into the annular duct. This reduces the opening speed and thus also the impact impulse of the outlet valve element at the axial stop of the guiding sleeve. In some embodiments, the annular duct makes it possible for the hydraulically effective areas from the pump side to the system side to be formed to be approximately equal in size. This reduces the opening pressure and thus the pressure peaks within the high-pressure fuel pump.

In some embodiments, the valve plate is fastened in the high-pressure port so as to be pressed in and calked, wherein the valve plate has an annular relief groove in a region of the second sealing seat in order to dissipate pressing and calking forces. If the valve plate is joined and calked into a high-pressure port via a press-fit assembly, the valve plate is sealed off with respect to the system pressure, which prevails for example in a common rail arranged downstream. The annular relief groove is, in some embodiments, provided to prevent the seat of the pressure-limiting valve from deforming as a result of the pressing and calking forces. The relief groove interrupts the stress flow from the outer calking region toward the second sealing seat for the pressure-limiting valve element. It is also possible, depending on active forces, for the relief groove to be dispensed with.

In some embodiments, in the high-pressure port, a spring carrier for a return spring for returning the pressure-limiting valve element into a closed position is pressed in, said spring carrier being formed from a harder material than the high-pressure port and projecting beyond an end region of the high-pressure port in the axial direction. Thus, in the high-pressure port, a spring carrier is pressed in, which is formed from a heat-treated material in order to provide the return spring of the pressure-limiting valve wear-resistant guidance and to prevent the tendency to seize during the pressing-in process. Furthermore, the opening pressure of the safety valve is set by way of the pressing-in dimension of the spring carrier.

In some embodiments, the outlet valve element, the pressure-limiting valve element, a first passage opening in the valve plate and a second passage opening in the outlet valve element are arranged coaxially.

In some embodiments, the guiding sleeve has at least one throughflow bore. When the outlet valve element is open, one fraction of the flow flows through the second passage opening and a further fraction flows past an outer diameter of the outlet valve element. Said further fraction is then conducted into the high-pressure region through the at least one throughflow bore.

Some embodiments may include a high-pressure fuel pump for subjecting a fuel in a fuel injection system of an internal combustion engine to high pressure has a pump housing in which the fuel is subjected to high pressure, and has a high-pressure port as described above which is arranged in a housing recess and is fixedly welded to the pump housing. A spring carrier which projects beyond the end region of the high-pressure port in the axial direction is arranged in the housing recess with a clearance fit, in particular with a clearance of 0.03-0.07 mm.

The fully assembled high-pressure port having the two valves (outlet valve and pressure-limiting valve) may be welded to the pump housing after it has been inserted into a housing recess on the pump housing. The projecting spring carrier forms, together with the pump housing, an overlap region which is designed in the form of a clearance fit.

In some embodiments, the pump housing forms, in the housing recess, an angled shoulder with an angle $\leq 90°$, wherein the end region of the high-pressure port has a turned groove, wherein the shoulder and the turned groove interact so as to form a free space. In some embodiments, the turned groove is provided with an angle $\leq 30°$, wherein the housing recess is likewise formed with an angle $\geq 60°$. A free space is formed by the turned groove together with the shoulder in the pump housing and then the spring carrier projecting beyond the high-pressure port, in which free space weld spatter can accumulate during the welding process and is trapped there. The described angles of $\leq 30°$ at the high-pressure port and $\leq 90°$ for the shoulder in the pump housing also increases the high-pressure resistance of the weld seam formed.

In some embodiments with the valves integrated in the high-pressure port, it is not necessary to provide any complex bore intersections in the pump housing, which reduces the production costs of the complete high-pressure fuel pump. Furthermore, this makes possible maximum flexibility for customer interfaces through 360° radially and with respect to height. The high-pressure port, as structural component, can be set and tested outside the high-pressure fuel pump. Overall, a diameter of the pump housing can be reduced, this being associated with reduced material usage. Pressure peaks, which arise within the high-pressure fuel pump, become smaller by up to 80%, this leading to a smaller load in the high-pressure-conducting region and in a drive region. The spatter protection during the joining process is already integrated by way of the special formation of the housing recess and of the high-pressure port.

In some embodiments, the guiding sleeve for guiding the outlet valve element provides wear-resistant interfaces with the outlet valve element and with the return spring, wherein, through the use of the heat-treated guiding sleeve, the high-pressure port may be produced from soft, weldable material, this resulting in an expedient joining process such as the welding of the high-pressure port to the pump housing. The turned recesses in the high-pressure port and the pump housing, which form the spray protection, at the same time increase the high-pressure resistance of the weld seam. Due to the pressing-in of the spring carrier in the high-pressure port, stresses which result therefrom improve the high-pressure resistance of the weld seam. Since the high-pressure port is of rotationally symmetric form, radial alignment with respect to the pump housing during the joining process is not absolutely necessary. Variation of the pressing-in dimension of the spring carrier in the high-pressure port and the easy accessibility to the pressure-limiting valve element allow the opening pressure of the pressure-limiting valve to be set easily.

FIG. 1 shows a longitudinal sectional illustration of a high-pressure port 10, which is fastened to a pump housing 12 of a high-pressure fuel pump 14. For this purpose, the high-pressure port 10 is inserted in a housing recess 16 of the pump housing 12 and fixedly welded there. In order to make possible a relatively simple welding process for fastening the high-pressure port 10 to the pump housing 12, the high-pressure port 10 is formed overall from a soft, easily weldable material. At an end region 18, by way of which the high-pressure port 10 is inserted into the housing recess 16, the high-pressure port 10 is of angled form, with an angle $\alpha \leq 30°$. The housing recess 16 is also of angled form, with an angle $\beta \geq 60°$. The high-pressure port 10 furthermore has a turned groove 20 at the end region 18. An angled shoulder 22 with an angle $\gamma = 90°$ is formed in the housing recess 16. The shoulder 22 on the housing recess 16 and the turned groove 20 on the high-pressure port 10 interact so as to form a free space 24. It is possible during the welding process for welding particles to accumulate in said free space 24, and to remain trapped there so that they are not able to enter the system of the high-pressure fuel pump 14 and lead to damage.

In the high-pressure port 10, there are arranged an outlet valve 26 and a pressure-limiting valve 28, for which a common valve plate 30 provides, respectively, a first sealing seat 32 for the outlet valve 26 and a second sealing seat 34 for the pressure-limiting valve 28. The outlet valve 26 has an outlet valve element 36 which is formed as a plate-shaped valve element and which has a planar sealing surface 38 via which the outlet valve element 36 interacts with the valve plate 30 for the purpose of closing the outlet valve 26. The outlet valve element 36 has, on a side opposite the planar sealing surface 38, a guiding projection 40 by way of which the outlet valve element 36 is, during its opening movement, guided in a guiding sleeve 42.

The guiding sleeve 42 is formed from a harder heat-treated material than the high-pressure port 10 and is pressed into the high-pressure port 10. Said sleeve has, at an end directed toward the outlet valve element 36, an inwardly directed guiding projection 44 which encircles the guiding projection 40 of the outlet valve element 36 and which thus provides a radial guide 46 for the outlet valve element 36. At the same time, the guiding projection 44 forms an axial stop 48 and thus limits the opening movement of the outlet valve element 36. All the interfaces at which wear-intensive movement takes place are consequently arranged between the heat-treated guiding sleeve 42 and the outlet valve element 36, with the result that no wearing of the high-pressure port 10 occurs.

The guiding sleeve 42 has, at an end directed away from the outlet valve element 36, a shoulder 50 against which there is supported a return spring 52 for returning the outlet valve element 36 into its closed position. The region between the shoulder 50 and that end region of the guiding sleeve 42 directed toward the outlet valve element 36 thereby forms a spring-receiving region 54, which retains and, during contraction and expansion, guides the return spring 52.

The pressure-limiting valve 28 has a spherical pressure-limiting valve element 56 which interacts with the second sealing seat 34 on the valve plate 30 for the purpose of closing the pressure-limiting valve 28 and which is preloaded into a closed position by a return spring 58. Arranged between the return spring 58 and the pressure-limiting element 56 is a guiding and retaining peg 60 which guides the pressure-limiting valve element 56 in its movement and against which the return spring 58 is supported. At an end of the return spring 58 arranged opposite the pressure-limiting valve element 56, the return spring 58 is supported against a spring carrier 62 which is pressed in the high-pressure port 10 and which projects beyond the end region 18 of the high-pressure port 10 in the axial direction. The spring carrier 62 is arranged in the housing recess 16 with a clearance fit, wherein there is a clearance of approximately 0.03-0.07 mm between the housing recess 16 and the spring carrier 62. The spring carrier 62 is also formed from a harder material than the high-pressure port 10.

The outlet valve 26 and the pressure-limiting valve 28 are arranged coaxially in the high-pressure port 10, and so structural space can be saved in the radial direction. For this purpose, the outlet valve element 36, the pressure-limiting valve element 56, a first passage opening 64 in the valve plate 30 and a second passage opening 66 in the outlet valve element 36 are arranged coaxially with respect to one another. The valve plate 30 furthermore has throughflow openings 68 which are arranged around the first passage opening 64 in a uniformly annular manner.

During operation, fuel in the pump housing 12 of the high-pressure fuel pump 14 is subjected to high pressure, then flows via the housing recess 16 through the pressure-limiting valve 28 and past the guiding and retaining peg 60 into the throughflow openings 68 of the valve plate 30 and acts counter to a spring force of the return spring 52 at the outlet valve 26. The return spring 52 is compressed, the outlet valve element 36 lifts off from the first sealing seat 32 and the pressurized fuel can then flow into a high-pressure region 70. If there is release of the pressure of the fuel proceeding from the pump housing 12, the return spring 52 expands again and presses the outlet valve element 36 onto the first sealing seat 32, with the result that the outlet valve 26 is closed. If the pressure in the high-pressure region 70 then exceeds a predetermined value, which corresponds to the opening pressure of the pressure-limiting valve 28, a pressure acts on the pressure-limiting valve element 56 via the second passage opening 66 in the outlet valve element 26 and the first passage opening 64 in the valve plate 30, with the result that said element lifts off from its second sealing seat 34 counter to the spring force of the return spring 58. The excessively high pressure in the high-pressure region 70 is thereby discharged back into the pump housing 12.

The valve plate 30 is shown in a perspective illustration in FIG. 2. Here, the valve plate 30 is shown in a view from the side of the outlet valve 26. It can be seen that the throughflow openings arranged in a uniformly annular manner open out into an encircling annular duct 72 which is arranged between two annular sealing surfaces 74 which interact with the planar sealing surface 38 of the outlet valve element 36. As a result of this arrangement of the throughflow openings 68, the outlet valve element 36 is flowed around with a relatively low throughflow speed, with the result that the opening speed of the outlet valve 26, and consequently an impact impulse at the axial stop 48, is reduced.

Figure 3:
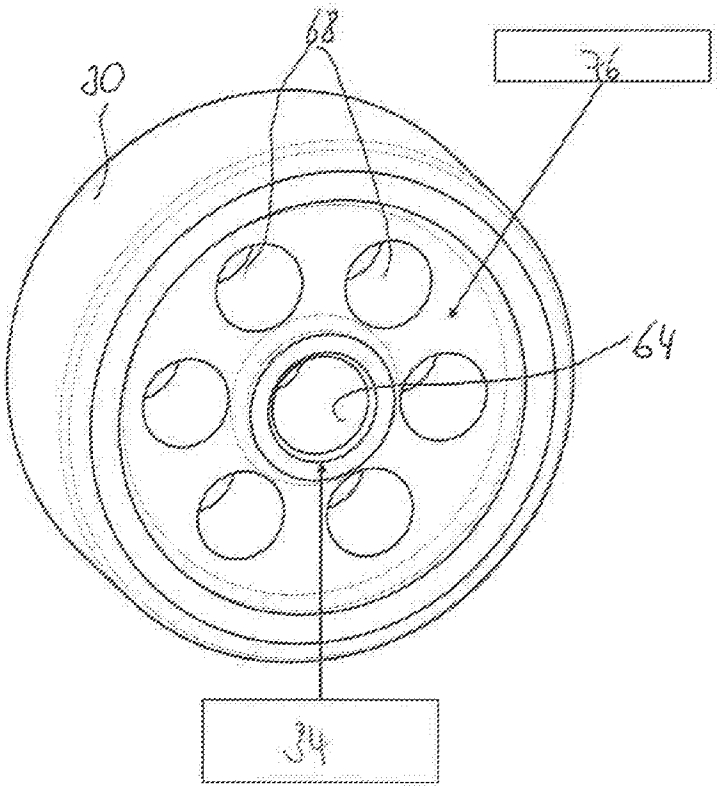
FIG. 3 shows a perspective illustration of the valve plate from FIG. 1, viewed from the direction of the pressure-limiting valve.
Figure 4:
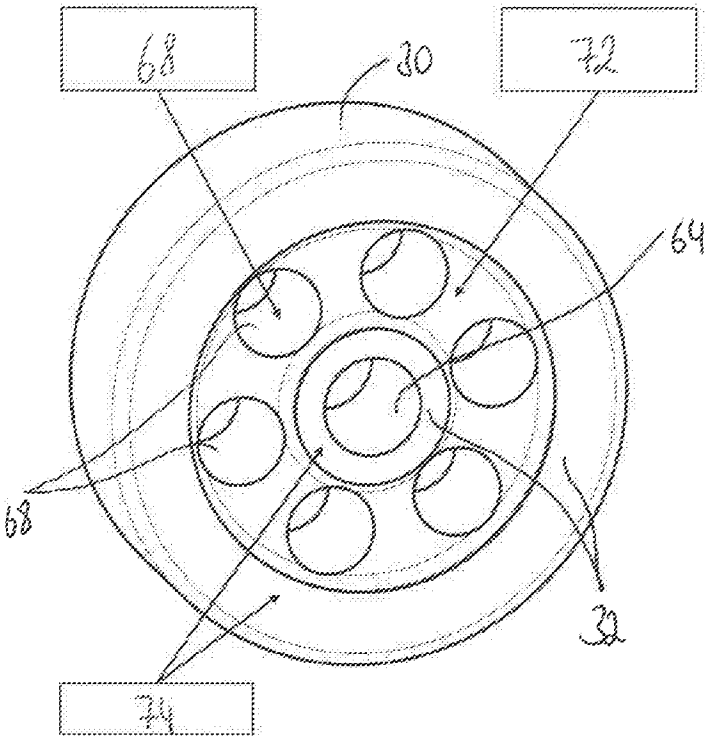

The valve plate 30 is, like the guiding sleeve 42, likewise fastened in the high-pressure port 10 so as to be pressed in and calked, as a result of which there is risk of the valve plate 30 deforming during the assembly. In order to counteract this, the valve plate 30 has, on the side opposite the annular duct 72, an annular relief groove 76 which absorbs and dissipates the pressing and calking forces during the assembly. Said relief groove 76 is shown in the perspective illustration of the valve plate 30 in FIG. 3.

In some embodiments, the described construction of the high-pressure port 10 having the valves introduced therein (outlet valve 26 and pressure-limiting valve 28) allows the provision of a fully assembled component which can already be checked prior to being fitted to the high-pressure fuel pump 14. The whole component can be fastened to the pump housing 12 by a simple joining method such as welding since the high-pressure port 10 itself is formed from an easily weldable soft material. The susceptibility to wear of the components can still be kept low since the guiding sleeve 42 and the spring carrier 62 and also the valve plate 30 are produced from a heat-treated material and pressed into the high-pressure port 10. They thus form the regions at which interfaces susceptible to wear are normally present.

The invention claimed is:

1. A high-pressure port for a high-pressure fuel pump of a fuel injection system, the high-pressure port comprising:

a body defining an internal volume;

an outlet valve with an outlet valve element opening in a first direction;

a pressure-limiting valve with a pressure-limiting valve element opening in a second direction opposite the first direction;

a common valve plate including a first sealing seat for the outlet valve element and a second sealing seat for the pressure-limiting valve element;

wherein the first sealing seat for the outlet valve element includes two concentric annular sealing surfaces spaced apart from each other in a radial direction by an encircling annular duct, wherein the two concentric annular sealing surfaces engage with a planar sealing surface of the outlet valve element to close and seal the outlet valve; and a guiding sleeve guiding the outlet valve element during movement, the guiding sleeve fastened in the body with an axial stop limiting movement of the outlet valve element and a radial guide guiding the outlet valve element during movement.

2. The high-pressure port as claimed in claim 1, wherein:

the outlet valve includes a return spring for returning the outlet valve element to a closed position; and the guiding sleeve comprises a spring receiving region for retaining and guiding the return spring.

3. The high-pressure port as claimed in claim 1, wherein:

the two concentric annular sealing surfaces of the first sealing seat comprise planar, annular sealing surfaces.

4. The high-pressure port as claimed in claim 1, wherein the valve plate comprises throughflow openings distributed in a uniformly annular manner and opening out into the encircling annular duct.

5. The high-pressure port as claimed in claim 1, wherein the valve plate is pressed into the body and calked; and the valve plate comprises an annular relief groove in a region of the second sealing seat dissipating pressing and calking forces.

6. The high-pressure port as claimed in claim 1, further comprising a spring carrier for a return spring for returning the pressure-limiting valve element into a closed position;

wherein the spring carrier is pressed into the body and comprises a harder material than the body; and the spring carrier projects beyond an end region of the body in the axial direction.

7. The high-pressure port as claimed in claim 1, wherein the guiding sleeve comprises a harder material than the body.

8. A high-pressure port for a high-pressure fuel pump of a fuel injection system, the high-pressure port comprising:

a body defining an internal volume;

an outlet valve with an outlet valve element opening in a first direction;

a pressure-limiting valve with a pressure-limiting valve element opening in a second direction opposite the first direction;

a common valve plate including a first sealing seat for the outlet valve element and a second sealing seat for the pressure-limiting valve element; and a guiding sleeve guiding the outlet valve element during movement, the guiding sleeve fastened in the body with an axial stop limiting movement of the outlet valve element and a radial guide guiding the outlet valve element during movement;

wherein the outlet valve element, the pressure-limiting valve element, a first passage opening in the valve plate, and a second passage opening in the outlet valve element are arranged coaxially.

9. A high-pressure fuel pump for subjecting a fuel in a fuel injection system of an internal combustion engine to high pressure, the pump comprising:

a pump housing in which the fuel is subjected to high pressure;

a high-pressure port arranged in a recess of the housing and welded to the pump housing, wherein the port comprises:

a body defining an internal volume;

an outlet valve with an outlet valve element opening in a first direction;

a pressure-limiting valve with a pressure-limiting valve element opening in a second direction opposite the first direction;

a common valve plate including a first sealing seat for the outlet valve element and a second sealing seat for the pressure-limiting valve element; and a guiding sleeve guiding the outlet valve element during movement, the guiding sleeve fastened in the body with an axial stop limiting movement of the outlet valve element and a radial guide guiding the outlet valve element during movement;

wherein the guiding sleeve comprises a harder material than the body;

a spring carrier projects beyond an end region of the body of the high-pressure port in an axial direction and is arranged in the housing recess with a clearance fit;

wherein the pump housing forms an angled shoulder in the housing recess with an angle $\gamma \leq 90°$, wherein an end region of the high-pressure port includes a turned groove, and wherein the shoulder and the turned groove interact to form a free space.

* * * * *